US005771719A

United States Patent [19]

Moon

[11] Patent Number: 5,771,719

[45] Date of Patent: Jun. 30, 1998

[54] WASHING MACHINE HAVING A CENTRIFUGAL PUMP

[75] Inventor: Sung-Dai Moon, Kyeongsangbuk-do, Rep. of Korea

[73] Assignee: Daewoo Electronics Co., Ltd., Seoul, Rep. of Korea

[21] Appl. No.: 715,759

[22] Filed: Sep. 19, 1996

[51] Int. Cl.[6] ..... D06F 17/12; D06F 39/02

[52] U.S. Cl. ..... 68/183; 68/23.6; 68/23.5

[58] Field of Search ..... 68/183, 23.6, 23.5, 68/53, 133, 207, 134; 134/102.1, 102.2, 184

[56] References Cited

U.S. PATENT DOCUMENTS

| | | | |
|---|---|---|---|
| 1,528,180 | 3/1925 | Ball | 68/183 |
| 2,270,805 | 1/1942 | Evans | 68/183 |
| 2,770,119 | 11/1956 | Walton | 68/183 |
| 2,983,130 | 5/1961 | Pinder | 68/18 |
| 3,799,179 | 3/1974 | Thomas | 134/95 |
| 4,727,734 | 3/1988 | Kanazawa et al. | 68/3 SS |
| 5,307,649 | 5/1994 | Lim et al. | 68/183 |
| 5,432,969 | 7/1995 | Oh | 68/3 R |
| 5,509,283 | 4/1996 | Lee et al. | 68/18 F |
| 5,653,129 | 8/1997 | Jang | 68/183 |

FOREIGN PATENT DOCUMENTS

| | | | |
|---|---|---|---|
| 495168 | 7/1992 | European Pat. Off. . | |
| 933950 | 5/1948 | France . | |
| 59-55293 | 3/1984 | Japan | 68/183 |
| 60-111690 | 6/1985 | Japan | 68/183 |
| 63-139597 | 6/1988 | Japan . | |
| 06277384 | 10/1994 | Japan . | |

*Primary Examiner*—Amy B. Vanatta
*Attorney, Agent, or Firm*—Beveridge, DeGrandi, Weilacher & Young LLP

[57] ABSTRACT

Disclosed is a washing machine having a centrifugal pump which not only sprays washing liquid onto the articles to be washed by circulating the washing liquid, but also supplies air bubbles into a spin tub, thereby improving the washing effect. The centrifugal pump includes a first housing, a second housing fixedly coupled to the first housing, an impeller accommodated in the first housing so as to circulate the washing liquid into a spraying nozzle or into an outer tub, a rotor which rotates in the forward and reverse directions, a driving shaft inserted into a center of the rotor in order to rotate together with the rotor, and a solenoid valve assembly for supplying the air to the impeller. The washing machine generates complex turbulence in the spin tub, thereby preventing the articles to be washed from being tangled at the center of the spin tub. The air bubbles supplied into the spin tub collide against the liquid flow generated by a pulsator so that they burst and impact against the articles, thereby not only improving the washing efficiency, but also easily dissolving the detergents.

22 Claims, 5 Drawing Sheets

WASHING MACHINE HAVING A CENTRIFUGAL PUMP

BACKGROUND OF THE INVENTION

1. Field of the Invention

The present invention relates to a washing machine, and more particularly to a washing machine having a centrifugal pump which not only sprays washing liquid onto the articles to be washed by circulating the washing liquid, but also supplies air bubbles into a spin tub, thereby improving the washing effect.

2. Prior Arts

As is well known, washing machines are classified into pulsator, agitator, and drum type washing machines according to their washing manner.

Among those washing machines, the pulsator type washing machine has a pulsator which is rotatably mounted on a bottom wall of a spin tub in order to generate a swirl-shaped liquid flow in the spin tub. In the pulsator type washing machine, the articles such as clothing are washed by friction between the swirl-shaped liquid flow and the articles. The pulsator type washing machine is widely used as a household washing machine.

However, the pulsator type washing machines have proven to be poor in their overall washing efficiency. Although it is possible to enhance the washing efficiency of the pulsator type washing machine by increasing the rotational speed of the pulsator, this may cause the articles to strongly collide with a side wall of the spin tub, thereby making damage to the articles. In contrast, if the rotational speed of the pulsator decreases, dirt contained in the articles does not completely separate from the articles.

In order to solve the above problems, a washing machine having an air bubble generator which generates air bubbles in a spin tub, thereby improving the washing efficiency has been suggested. U.S. Pat. application Ser. No. 5,307,649 issued to LIM et al. discloses a washing machine having an air bubble generator.

FIG. 5 shows the washing machine issued to LIM et al.

As shown in FIG. 5, LIM's washing machine 400 comprises a housing 10 and a stationary washer tub 12 fixedly mounted within housing 10 for receiving washing liquid or detergent solution therein. Connected to the bottom of stationary washer tub 12 is a drain pipe 14 which allows the washing liquid to flow out of stationary washer tub 12 during the washing, dehydrating, and rinsing operations. Washing machine 400 further includes an electric motor 18 having a drive shaft 16, and a clutch assembly 24 having first and second driven shafts 20 and 22.

Both electric motor 18 and clutch assembly 24 are secured to stationary washer tub 12 by means of suitable fastener means, e.g., welding or threading. Drive shaft 16 is operatively connected to first and second driven shafts 20 and 22 through a belt transmission mechanism 26. Clutch assembly 24 serves to selectively transmit the driving force generated by electric motor 18 to one of first and second shafts 20 and 22.

First driven shaft 20 is connected to a spin tub 28. Spin tub 28 is formed at its side wall with a plurality of washing liquid communication holes 30 for permitting the washing liquid to flow into or out of spin tub 28, and is formed at its bottom wall with a bubble passage 32 through which air bubbles flow into spin tub 28. Second driven shaft 22 is connected to a pulsator 34 mounted on the bottom of spin tub 28. Pulsator 34 has a plurality of perforation holes(not shown) through which air bubbles that have passed through bubble passage 32 flow into spin tub 28.

A bubble generator 35 is mounted on the bottom surface of stationary washer tub 12. Bubble generator 35 is connected to an air pump 38 through an air conduit 36 and generates a pressurized air under a precise control of a control device 40.

Washing machine 400 having the above construction operates as follows.

In the washing mode, when the washing liquid in spin tub 28 reaches a predetermined level, a microcomputer(not shown) sends an operating signal to electric motor 18, thereby driving electric motor 18. The driving force of electric motor 18 is transferred to second driven shaft 22 by way of driving shaft 16, belt transmission mechanism 26 and clutch assembly 24, so that pulsator 34 connected to second driven shaft 22 may rotate in the forward and reverse directions.

While the washing mode is being executed, the microcomputer sends an operating signal to control device 40 so as to operate air pump 38. Air generated by air pump 38 flows into stationary washer tub 12 through air conduit 36 and bubble generator 35 mounted on the bottom wall of stationary washer tub 12. The air that has flowed into stationary washer tub 12 is mixed with the washing liquid contained in stationary washer tub 12, thereby forming air bubbles.

The air bubbles flow into spin tub 28 by passing through bubble passage 32 formed at the bottom of spin tub 28 and the perforation holes formed in pulsator 34. The air bubbles collide against the liquid flow generated by pulsator 34 so that they burst and impact against the articles, thereby not only improving the washing efficiency, but also easily dissolving the detergents.

However, since air pump 38 for generating the air, control device 40 for controlling air pump 38, and bubble generator 35 are separately installed in washing machine 400, washing machine 400 requires many securing elements for assembling them in washing machine 400. For this reason, many steps and elements are needed for assembling washing machine 400.

SUMMARY OF THE INVENTION

The present invention has been made to overcome the above described problems of the prior art, and accordingly it is an object of the present invention to provide a washing machine having a centrifugal pump which not only sprays washing liquid onto the articles to be washed by circulating the washing liquid, but also supplies air bubbles into a spin tub, thereby improving the washing effect.

To achieve the above object, the present invention provides a washing machine comprising:

a cabinet;

an outer tub for receiving a washing liquid, the outer tub being disposed in the cabinet;

a spin tub having a plurality of discharging pores at a side wall, the spin tub being accommodated in the outer tub;

a pulsator for generating a swirl-shaped liquid flow in the spin tub, the pulsator being mounted on a bottom wall of the spin tub;

a motor for generating a rotational force;

a first means for rotating the spin tub;

a second means for rotating the pulsator; and a third means for circulating the washing liquid into a spraying nozzle mounted on an upper portion of the outer tub and for generating an air bubble in the washing liquid, the third means supplying the washing liquid having the air bubble into the outer tub.

According to a preferred embodiment of the present invention, the first means includes a rotating plate secured to a bottom surface of the spin tub and a spin tub driving shaft connected to the motor so as to receive the rotational force from the motor. The spin tub driving shaft is securely inserted into a center portion of the rotating plate.

The second means includes a pulsator driving shaft connected to the motor so as to receive the rotational force from the motor.

The outer tub is formed at a bottom wall thereof with a first fluid port for discharging the washing liquid to the third means and, with a second fluid port for receiving the washing liquid from the third means. The pulsator has a plurality of first blades for generating the swirl-shaped liquid flow in the spin tub, and has a center hole formed at a center thereof. Each first blade has at least one aperture in the vicinity of the center of the pulsator.

The third means includes a first housing, a second housing fixedly coupled to the first housing, a fourth means for circulating the washing liquid into the spraying nozzle or into the second fluid port, a fifth means for rotating the fourth means, and a sixth means for supplying an air to the fourth means.

The first housing includes a fluid inlet connected to the first fluid port of the outer tub through a first fluid pipe so as to receive the washing liquid, a first duct connected to the spraying nozzle through a circulation tube, and a second duct connected to the second fluid port of the outer tub through a second fluid pipe.

The fourth means includes an impeller accommodated in the first housing, the impeller having a suction opening for sucking the washing liquid that has flowed through the fluid inlet of the first housing, a plurality of second blades for transferring the sucked washing liquid to the first duct or the second duct of the first housing while applying a centrifugal force to the sucked washing liquid, and a hub securely coupled to the fifth means in order to receive a rotational force from the fifth means.

The fifth means includes a stator accommodated in the second housing so as to receive an electric signal from a microcomputer, a rotor surrounded by the stator so as to rotate in the forward and reverse directions for a predetermined period when the electric signal is applied to the stator, and a driving shaft inserted in a center of the rotor in order to rotate together with the rotor.

The sixth means includes a solenoid valve assembly and a fluid passage which longitudinally passes through the driving shaft.

The washing machine having the above construction operates as follows.

In the washing mode, when the washing liquid in the spin tub reaches a predetermined level, the microcomputer sends an operating signal to the motor so that the motor is driven. The driving force of the motor is transferred to the pulsator driving shaft so that the pulsator connected to the pulsator driving shaft may rotate in the forward and reverse directions.

At the same time, the microcomputer applies electric signals to both the solenoid valve assembly and the stator. As a result, the rotor repeatedly rotates in the forward and reverse directions. The rotational force of the rotor is transferred to the impeller, so the impeller rotates in the forward and reverse directions. As a result, the washing liquid in the outer tub flows into the suction opening of the impeller.

At the same time, when the electric signal is applied to the solenoid valve assembly, the air existing outside of the solenoid valve assembly intermittently flows into the impeller through the solenoid valve assembly.

At this time, the air that has flowed into the impeller is mixed with the washing liquid thereby generating air bubbles. Accordingly, a washing liquid having the air bubbles therein is transferred to the first duct or the second duct.

The microcomputer adjusts the flow rate of the air guided into the impeller by controlling the solenoid valve assembly according to a predetermined algorithm thereby generating a proper amount of the air bubbles.

The washing liquid having the air bubbles is guided into the second duct through the second blades of the impeller when the impeller rotates in the forward direction. The guided washing liquid flows into the spin tub through the center hole formed at the center of the pulsator and the aperture formed in the first blades.

In this manner, the washing liquid having the air bubbles is supplied to the spin tub through the center of the pulsator while the washing mode is being executed.

Meanwhile, the washing liquid having the air bubbles flows into the first duct through the second blades of the impeller when the impeller rotates in the reverse direction. At this time, the washing liquid circulates into the spraying nozzle mounted on the upper portion of the outer tub. The circulated washing liquid is sprayed onto the articles loaded in the spin tub thereby improving the washing effect.

As described above, since the washing machine of the present invention supplies the washing liquid having the air bubbles into the spin tub through the center of the pulsator, complex turbulence is generated in the spin tub thereby preventing the articles from being tangled at the center of the spin tub.

Further, since the pump section not only circulates the washing liquid, but also generates the air bubbles, the washing machine of the present invention does not require both a separate bubble generator and a fastening means for assembling the bubble generator into the washing machine, so the assembling of the washing machine is simplified.

Furthermore, when the washing mode is being executed, the air bubbles supplied into the spin tub collide against the liquid flow generated by the pulsator so that they burst and impact against the articles, thereby not only improving the washing efficiency, but also easily dissolving the detergents.

BRIEF DESCRIPTION OF THE DRAWINGS

The above object and other advantages of the present invention will become more apparent by describing in detail a preferred embodiment thereof with reference to the attached drawings, in which.

DESCRIPTION OF THE PREFERRED EMBODIMENTS

Hereinafter, the present invention will be described in detail with reference to the accompanying drawings.

Figure 1:
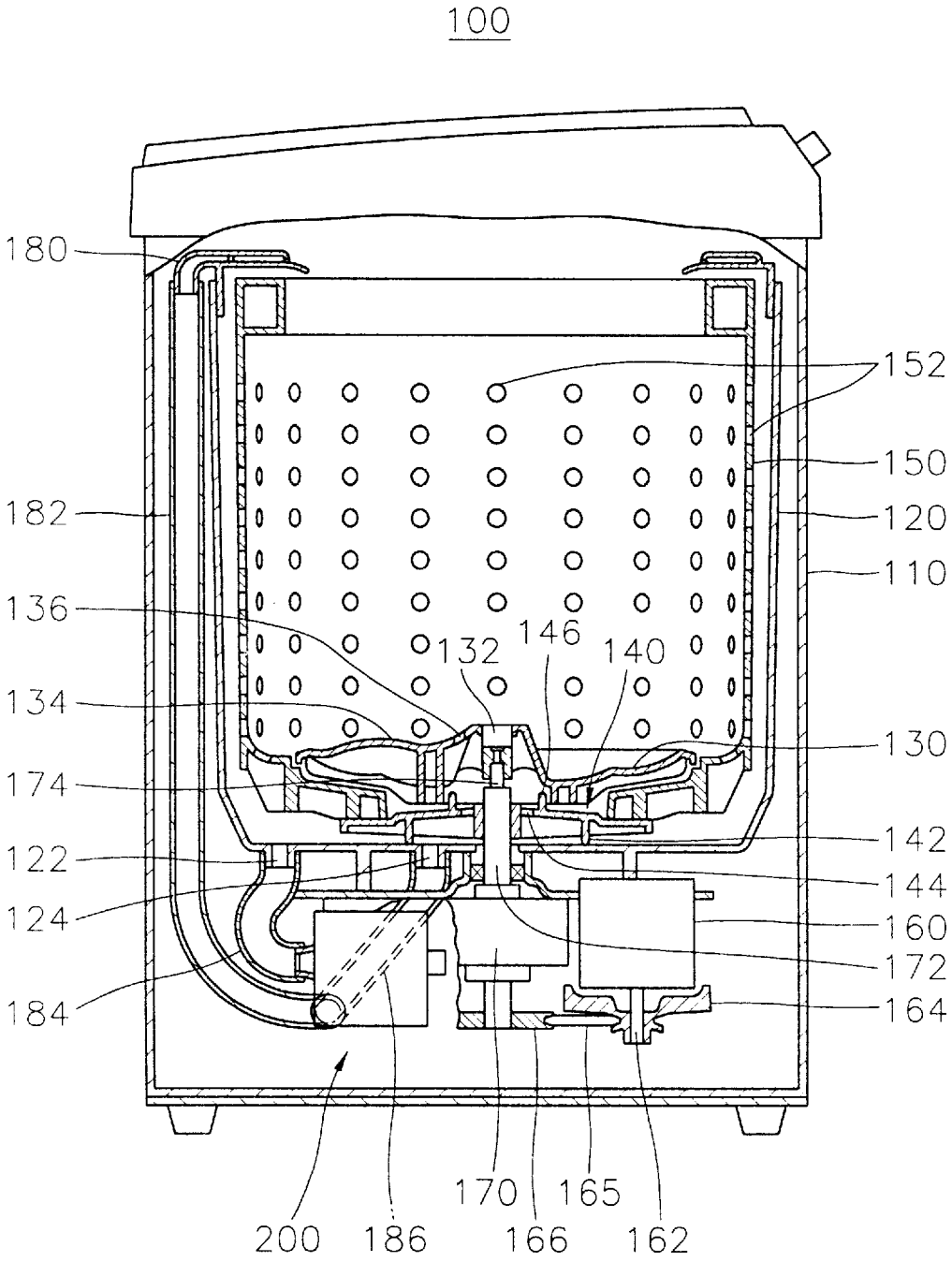
FIG. 1 is a sectional view showing the structure of a washing machine according to one embodiment of the present invention.

FIG. 1 shows a sectional view of a washing machine 100 according to one embodiment of the present invention.

As shown in FIG. 1, washing machine 100 comprises a cabinet 110. An outer tub 120 for receiving a washing liquid and a spin tub 150 which is accommodated in outer tub 120 are disposed in cabinet 110. Spin tub 150 is formed at its side wall with a plurality of discharging pores 152. First and second fluid ports 122 and 124 are formed at a bottom wall of outer tub 120, and pulsator 130 for generating a swirl-shaped liquid flow in spin tub 150 is mounted on a bottom wall of spin tub 150. A rotating plate 140 for rotating spin tub 150 is fixedly secured to a bottom surface of spin tub 150.

Rotating plate 140 has a receptacle 142 which makes contact with the bottom wall of outer tub 120 so as to receive the washing liquid that has flowed through second fluid port 124. A guide hole 144 for guiding the washing liquid to pulsator 130 is formed at the center of rotating plate 140. The washing liquid that has flowed into guide hole 144 is introduced into the center of pulsator 130 by an annular guide strip 146 formed at an upper surface of rotating plate 140.

Pulsator 130 has a plurality of first blades 134 for generating the swirl-shaped liquid flow in spin tub 150, and a center hole 132 at the center of pulsator 130. Each of first blades 134 has at least one aperture 136 in the vicinity of the center of pulsator 130. Accordingly, the washing liquid that has passed through guide hole 144 of rotating plate 140 flows into spin tub 150 through center hole 132 and aperture 136.

A motor 160 having a motor shaft 162 and generating a driving force is installed at a lower portion of cabinet 110. In addition, a pump section 200, which circulates the washing liquid into a spraying nozzle 180 and supplies air bubbles into outer tub 120, is installed in cabinet 110 opposite to motor 160. Pump section 200 is communicated with spraying nozzle 180 through a circulation tube 182, and is communicated with first and second fluid ports 122 and 124 through first and second fluid pipes 184 and 186, respectively. Pump section 200 includes a centrifugal pump. Pump section 200 will be described in detail with reference to FIG. 2.

A first pulley 164 is provided at a distal end of motor shaft 162. First pulley 164 is connected to a second pulley 166, which is coupled to a first end of a pulsator driving shaft 174, by a belt 165 so that the driving force of motor 160 is transferred to pulsator 130. Disposed above second pulley 166 is a gear mechanism 170 which transfers the driving force of motor 160 to a spin tub driving shaft 172 or pulsator driving shaft 174.

Pulsator driving shaft 174 is rotatably accommodated in spin tub driving shaft 172. A second end of pulsator driving shaft 174 is fixedly coupled to the center of the bottom surface of pulsator 130 so that pulsator 130 may rotate as pulsator driving shaft 174 rotates. In addition, spin tub driving shaft 172 is securely inserted into the center portion of rotating plate 140 so that spin tub 150 is rotated by rotating plate 140 when spin tub driving shaft 172 rotates.

Figure 2:
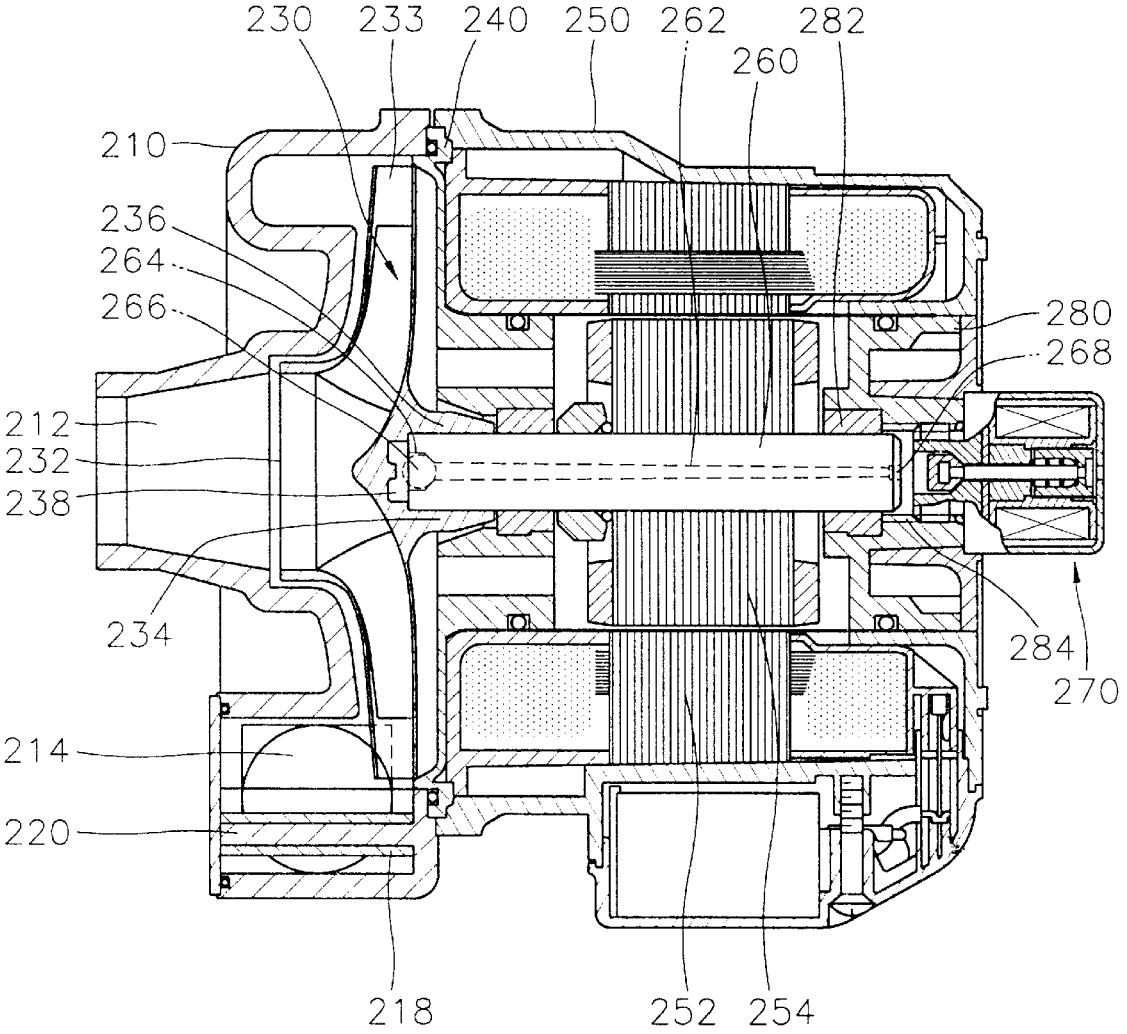
FIG. 2 is an enlarged view of a centrifugal pump shown in FIG. 1.

Referring to FIG. 2, pump section 200 includes a first housing 210, a cover 240 fixedly attached to one end of first housing 210, and a second housing 250 which is coupled to cover 240 by a fastening means such as welding.

Figure 3:
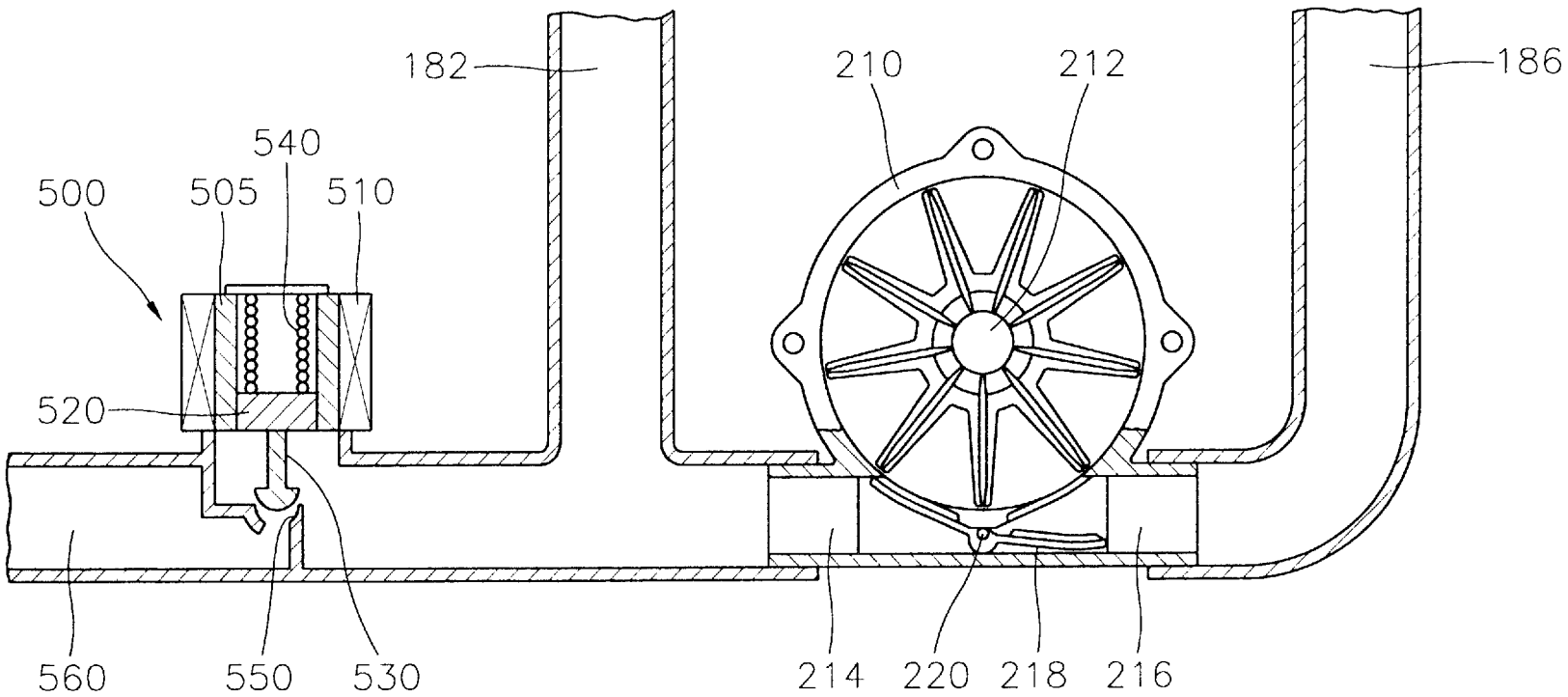
FIG. 3 is a sectional view showing fluid passages for washing liquid.

First housing 210 has a fluid inlet 212 which is connected to first fluid port 122 of outer tub 120 by first fluid pipe 184 in order to receive the washing liquid. As shown in FIG. 3, a first duct 214 connected to spraying nozzle 180 by circulation tube 182 and a second duct 216 connected to second fluid port 124 of outer tub 120 by second fluid pipe 186 are formed at a lower portion of first housing 210. A two-way valve 218, which pivotably moves about a hinge shaft 220 for guiding the washing liquid to first duct 214 or second duct 216, is disposed between first and second ducts 214 and 216.

Referring again to FIG. 2, first housing 210 has an impeller 230 therein. Impeller 230 includes a suction opening 232 into which the washing liquid that has flowed through fluid inlet 212 is sucked, a plurality of second blades 233 for transferring the sucked washing liquid to first duct 214 or second duct 216 while applying a centrifugal force to the sucked washing liquid, and a hub 234 which is securely coupled to a driving shaft 260 in order to receive the rotational force of driving shaft 260. Hub 234 has a plurality of fluid channels 236 communicated with suction opening 232. In addition, hub 234 has a space 238 formed inside of it.

Disposed in second housing 250 are a stator 252, to which an electric signal is applied from a microcomputer(not shown), and a rotor 254 surrounded by stator 252 so as to rotate when the electric signal is applied to stator 252. Driving shaft 260 is inserted into the center of rotor 254 so that driving shaft 260 may rotate together with rotor 254 as rotor 254 rotates.

Driving shaft 260 extends through the center of rotor 254, and a first end of driving shaft 260 is fixedly inserted in hub 234 and a second end of driving shaft 260 is rotatably inserted into a bearing 282 of a bearing holder 280 inserted into a distal end of second housing 250. In addition, driving shaft 260 has a fluid passage 262 which longitudinally passes therethrough. An air inlet 268 is formed at a first end of fluid passage 262, and a recess 264 in which a check valve 266 is accommodated is formed at a second end of fluid passage 262. Fluid passage 262 tapers from the second end thereof to the first end thereof so that the speed of the air flowing into fluid passage 262 gradually decreases while passing through fluid passage 262, thereby the noise caused by a collision of the air with the washing liquid is reduced.

Figure 4:
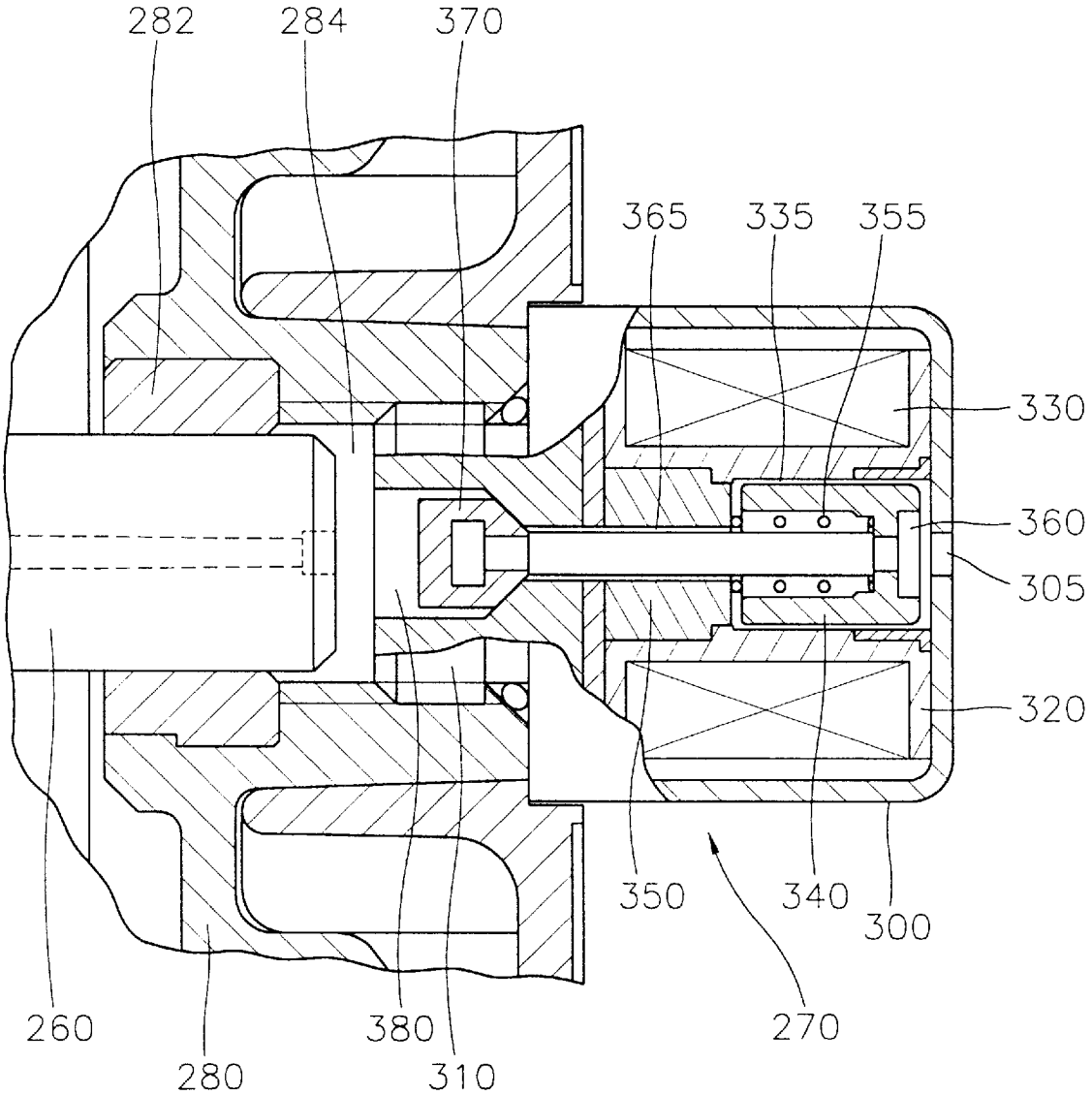
FIG. 4 is an enlarged view of a solenoid and valve assembly shown in FIG. 2.
Figure 5:
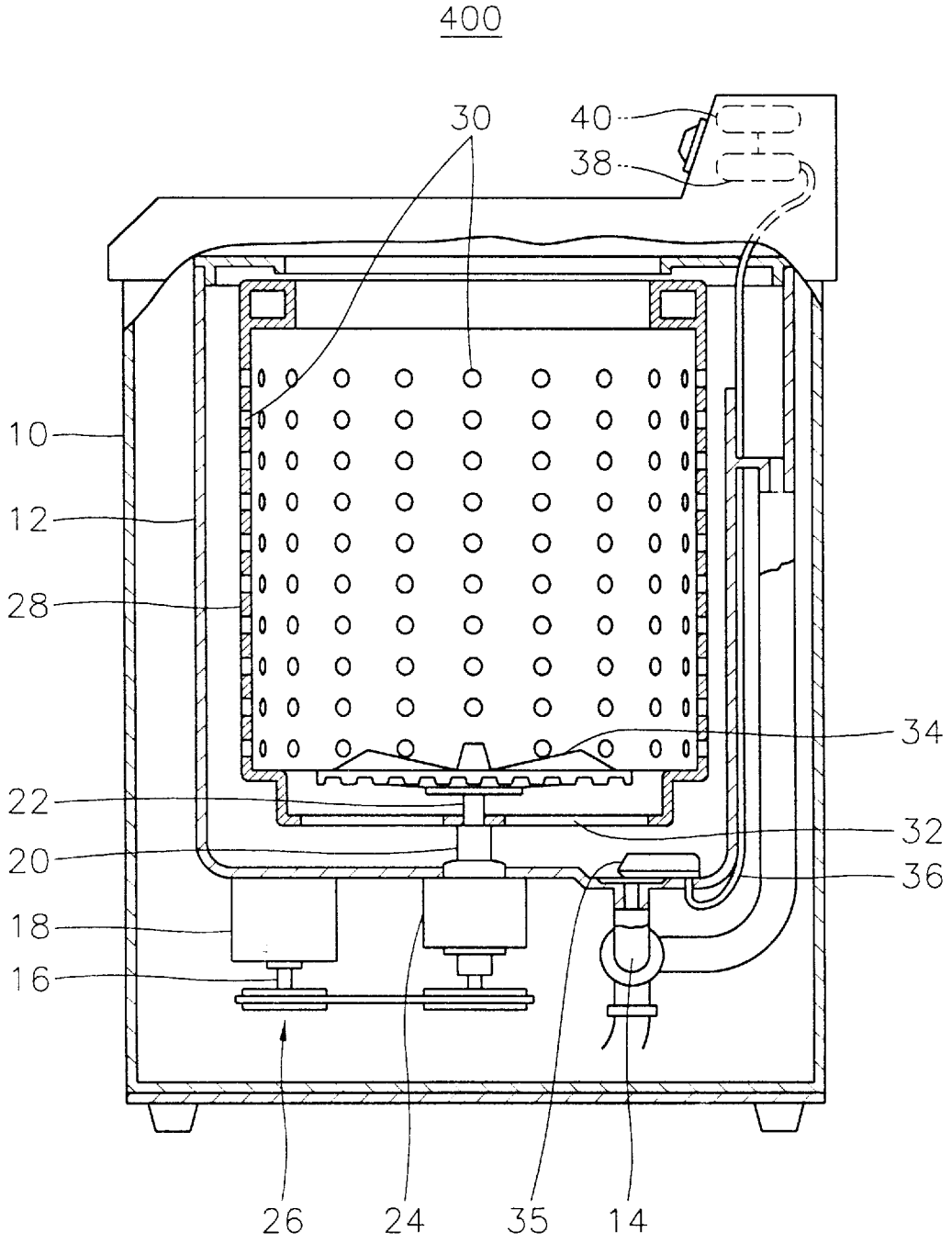
FIG. 5 (PRIOR ART)
FIG. 5 is a sectional view showing the structure of a conventional washing machine.

Bearing holder 280 is formed at the center thereof with a screw hole 284 into which a first solenoid valve assembly 270 is screw-coupled. Referring to FIG. 4, first solenoid valve assembly 270 includes a casing 300 having an opening 305 for receiving an air existing outside of pump section 200, and a screw portion 310 having a valve chamber 380 communicated with fluid passage 262. Screw portion 310 is screw-coupled into screw hole 284 of bearing holder 280. Provided in valve chamber 380 is a spool valve 370 which intermittently blocks the air flowing into valve chamber 380.

A hollow bobbin 320 is installed in casing 300. A first solenoid 330 is wound around the periphery wall of hollow bobbin 320. Disposed in hollow bobbin 320 are a first movable core 340 which reciprocates within hollow bobbin 320 as an intermittent electric signal is applied to first solenoid 330, a supporting member 350 for restraining the movement of first movable core 340, a first spring 355 which is positioned between first movable core 340 and supporting member 350 in order to elastically support first movable core 340, and an actuating rod 360 coupled to first movable core 340 so as to move together with first movable core 340. A first end of actuating rod 360 is coupled to first movable core 340, and second end of actuating rod 360 extends through supporting member 350 to valve chamber 380 and is coupled to spool valve 370 in valve chamber 380.

In addition, in order to introduce air into pump section 200, a first gap 335 is formed between the outer wall of first movable core 340 and the inner wall of hollow bobbin 320, and a second gap 365 is formed between the inner wall of supporting member 350 and the outer wall of actuating rod 360. On the other hand, as shown in FIG. 3, a second solenoid valve assembly 500, which opens and closes a draining pipe 560 according to an electric signal from the microcomputer, is provided at a predetermined position in draining pipe 560.

Second solenoid valve assembly 500 includes a hollow cylinder 505 and a second solenoid 510 wound around the periphery wall of hollow cylinder 505. Disposed in hollow cylinder 505 are a second movable core 520 formed integrally with a piston valve 530, and a second spring 540 which is positioned above second movable core 520 in order to make piston valve 530 rest in a valve seat 550.

Washing machine 100 having the above construction operates as follows.

In the washing mode, when the washing liquid in spin tub 150 reaches a predetermined level, the microcomputer sends an operating signal to motor 160 so that motor 160 is driven. The driving force of motor 160 is transferred to pulsator driving shaft 174 by way of motor shaft 162, first pulley 164, belt 165, second pulley 166 and gear mechanism 170, so that pulsator 130 connected to pulsator driving shaft 174 may rotate in the forward and reverse directions.

At the same time, the microcomputer applies electric signals to both first solenoid 330 and stator 252 of pump section 200.

As the electric signal is applied to stator 252, rotor 254 surrounded by stator 252 rotates in the forward and reverse directions for a predetermined period which is preset in the microcomputer. The rotational force of rotor 254 is transferred to impeller 230, so impeller 230 rotates in the forward and reverse directions. As a result, the washing liquid in outer tub 120 flows into suction opening 232 of impeller 230 by way of first fluid port 122 of outer tub 120, first fluid pipe 184, and fluid inlet 212 of first housing 210. Then, some of the washing liquid flows into space 238 through fluid channels 236 of hub 234, and a remaining washing liquid flows into first duct 214 or second duct 216 by means of second blades 233 of impeller 230. At this time, a pressure in space 238 is lowered below an atmospheric pressure due to the rotation of second blades 233.

At the same time, as the electric signal is applied to first solenoid 330, first movable core 340 reciprocates within hollow bobbin 320 so that spool valve 370 coupled to the second end of actuating rod 360 is intermittently opened and closed. Therefore, the air existing outside of pump section 200 intermittently flows into valve chamber 380 by passing through first gab 335 formed between the outer wall of first movable core 340 and the inner wall of hollow bobbin 320 and second gab 365 formed between the inner wall of supporting member 350 and the outer wall of actuating rod 360.

At this time, since the pressure in space 238 is lowered to below the atmospheric pressure, the air that has flowed into valve chamber 380 flows into space 238 through fluid passage 262 of driving shaft 260 and pushes check valve 266 resting in recess 264 due to a differential pressure between space 238 and valve chamber 380. Then, the air is mixed with the washing liquid thereby generating air bubbles. Accordingly, a washing liquid having the air bubbles therein is transferred to first duct 214 or second duct 216.

The microcomputer adjusts the flow rate of the air guided into pump section 200 by controlling first solenoid valve assembly 270 according to a predetermined algorithm thereby generating a proper amount of air bubbles.

On the other hand, as shown in FIG. 3, the washing liquid having the air bubbles flows into second duct 216 through second blades 233 of impeller 230 while impeller 230 rotates in the forward direction. At this time, pressure of the washing liquid flowing into second duct 216 causes two-way valve 218 open second duct 216 and to close first duct 214. Accordingly, the washing liquid is guided into guide hole 144 of rotating plate 140 through second fluid pipe 186, second fluid port 124 of outer tub 120, and receptacle 142 of rotating plate 140.

Then the guided washing liquid flows into spin tub 150 through center hole 132 formed at the center of pulsator 130 and through aperture 136 formed in first blades 134. In this manner, the washing liquid having the air bubbles is supplied to spin tub 150 through the center of pulsator 130 while the washing mode is being executed. Accordingly, complex turbulence is generated in spin tub 150, thereby preventing the articles from becoming tangled at the center of spin tub 150. In addition, the air bubbles collide against the liquid flow generated by pulsator 130, so that they burst and impact against the articles thereby not only improving the washing efficiency, but also easily dissolving the detergents.

Meanwhile, the washing liquid having the air bubbles flows into first duct 214 through second blades 233 of impeller 230 while impeller 230 rotates in the reverse direction. At this time, the pressure of the washing liquid flowing into first duct 214 causes two-way valve 218 to open first duct 214 and to close second duct 216. Accordingly, the washing liquid circulates through circulation tube 182 into spraying nozzle 180 mounted on the upper portion of outer tub 120. Then, the circulated washing liquid is sprayed onto the articles loaded in spin tub 150, thereby improving the washing effect.

In the dehydrating mode, the rotational force of motor 160 is transferred to spin tub driving shaft 172 by means of gear mechanism 170 so that rotating plate 140 coupled to spin tub driving shaft 172 may rotate, thereby rotating spin tub 150. As spin tub 150 rotates, the articles loaded in spin tub 150 are forced toward the side wall of spin tub 150 by means of the centrifugal force applied thereto. As a result, the washing liquid contained in the articles is discharged through discharging pores 152 formed at the side wall of spin tub 150.

At the same time, the microcomputer applies an electric signal to stator 252 so as to rotate rotor 254 in the reverse direction. As impeller 230 rotates in the reverse direction, the washing liquid discharged from the articles flows into first duct 214 through second blades 233 of impeller 230.

At this time, the microcomputer applies an electric signal to second solenoid valve assembly 500, so second movable core 520 resting on valve seat 550 moves upward while overcoming the biasing force of second spring 540. Therefore, the washing liquid that has passed through first duct 214 drains out of washing machine 100 through draining pipe 560.

As described above, since the washing machine of the present invention supplies the washing liquid having the air bubbles into the spin tub through the center of the pulsator, complex turbulence is generated in the spin tub thereby preventing the articles from becoming tangled at the center of the spin tub.

Further, since the pump section not only circulates the washing liquid, but also generates the air bubbles, the washing machine of the present invention does not require both a separate bubble generator and a fastening means for assembling the bubble generator into the washing machine, so the assembling of the washing machine is simplified.

Furthermore, when the washing mode is being executed, the air bubbles supplied into the spin tub collide against the liquid flow generated by the pulsator, so that they burst and impact against the articles, thereby not only improving the washing efficiency, but also easily dissolving the detergents.

While the present invention has been particularly shown and described with reference to the preferred embodiment thereof, it will be understood by those skilled in the art that various changes in form and detail may be effected therein without departing from the spirit and scope of the invention as defined by the appended claims.

What is claimed is:

1. A washing machine comprising:

a cabinet;

an outer tub for receiving a washing liquid, the outer tub being disposed in the cabinet;

a spin tub having a plurality of discharging pores at a side wall, the spin tub being accommodated in the outer tub;

a pulsator for generating a swirl-shaped liquid flow in the spin tub, the pulsator being mounted on a bottom wall of the spin tub;

a motor for generating a rotational force;

a first means for rotating the spin tub;

a second means for rotating the pulsator; and a third means for circulating the washing liquid into a spraying nozzle mounted on an upper portion of the outer tub and for generating an air bubble in the washing liquid, the third means supplying the washing liquid having the air bubble into the outer tub.

2. The washing machine as claimed in claim 1, wherein the outer tub is formed at a bottom wall thereof with a first fluid port for discharging the washing liquid to the third means and second fluid port for receiving the washing liquid from the third means.

3. The washing machine as claimed in claim 2, wherein the first means includes a rotating plate secured to a bottom surface of the spin tub and a spin tub driving shaft connected to the motor so as to receive the rotational force from the motor, the spin tub driving shaft being securely inserted into a center portion of the rotating plate.

4. The washing machine as claimed in claim 3, wherein the second means includes a pulsator driving shaft connected to the motor so as to receive the rotational force from the motor, the pulsator driving shaft being rotatably accommodated in the spin tub driving shaft, and a lead end of the pulsator driving shaft being fixedly coupled to a center of a bottom surface of the pulsator.

5. The washing machine as claimed in claim 3, wherein the pulsator has a plurality of first blades for generating the swirl-shaped liquid flow in the spin tub and has a center hole formed at a center thereof, each first blade having at least one aperture in the vicinity of the center of the pulsator.

6. The washing machine as claimed in claim 5, wherein the rotating plate includes a receptacle which makes contact with the bottom wall of the outer tub so as to receive the washing liquid flowed from the third means through the second fluid port, a guide hole for guiding the washing liquid toward the pulsator, and an annular guide strip for introducing the washing liquid into the center hole of the pulsator and into the aperture of each blade.

7. The washing machine as claimed in claim 2, wherein the third means includes a first housing, a second housing fixedly coupled to the first housing, a fourth means for circulating the washing liquid into the spraying nozzle or into the second fluid port, a fifth means for rotating the fourth means, and a sixth means for supplying an air to the fourth means.

8. The washing machine as claimed in claim 7, wherein the first housing includes a fluid inlet connected to the first fluid port of the outer tub by a first fluid pipe so as to receive the washing liquid, a first duct connected to the spraying nozzle by a circulation tube, and a second duct connected to the second fluid port of the outer tub by a second fluid pipe.

9. The washing machine as claimed in claim 8, wherein a two-way valve is disposed between the first and second ducts, the first and second ducts being selectively opened and closed by the two-way valve.

10. The washing machine as claimed in claim 8, wherein the fourth means includes an impeller accommodated in the first housing, the impeller having a suction opening for sucking the washing liquid that has flowed through the fluid inlet of the first housing, a plurality of second blades for transferring the sucked washing liquid to the first duct or the second duct of the first housing while applying a centrifugal force to the sucked washing liquid, and a hub securely coupled to the fifth means in order to receive a rotational force from the fifth means.

11. The washing machine as claimed in claim 10, wherein the hub has a plurality of fluid channels communicated with the suction opening and a space formed in the hub.

12. The washing machine as claimed in claim 10, wherein the fifth means includes a stator accommodated in the second housing so as to receive an electric signal from a microcomputer, a rotor surrounded by the stator so as to rotate in forward and reverse directions for a predetermined period as the electric signal is applied to the stator, and a driving shaft inserted into a center of the rotor in order to rotate together with the rotor.

13. The washing machine as claimed in claim 12, wherein the driving shaft has a first and a second end which are opposite to each other, the first end of the driving shaft being fixedly inserted into the hub and the second end of the driving shaft being rotatably inserted into a bearing of a bearing holder which is inserted into a distal end of the second housing, the bearing holder having a screw hole formed at a center thereof.

14. The washing machine as claimed in claim 13, wherein the sixth means includes a first solenoid valve assembly and a fluid passage which longitudinally passes through the driving shaft.

15. The washing machine as claimed in claim 14, wherein the fluid passage has an air inlet at a first end thereof and a recess at a second end thereof, the first and second ends being opposite to each other, and the recess having a check valve therein.

16. The washing machine as claimed in claim 15, wherein the fluid passage tapers from the second end thereof to the first end thereof.

17. The washing machine as claimed in claim 14, wherein the first solenoid valve assembly includes a casing having an opening for receiving an air, a screw portion having a valve chamber communicated with the fluid passage, a spool valve accommodated in the valve chamber so as to intermittently block the air flowing into the valve chamber, a hollow bobbin installed in the casing, a solenoid wound around a periphery wall of the hollow bobbin, a movable core which reciprocates within the hollow bobbin when an intermittent electric signal is applied to the solenoid, a supporting member for restraining a movement of the movable core, a spring disposed between the movable core and supporting member in order to elastically support the movable core, and an actuating rod for intermittently pushing the spool valve so as to allow the air to flow into the valve chamber, the screw portion being screw-coupled into the screw hole of the bearing holder.

18. The washing machine as claimed in claim 17, wherein the actuating rod has a first and a second end which are opposite to each other, the first end of the actuating rod being fixedly coupled to the movable core, and the second end of the actuating rod being extended up to the valve chamber and being coupled to the spool valve in the valve chamber.

19. The washing machine as claimed in claim 17, wherein a first gap is formed between an outer wall of the movable core and an inner wall of the hollow bobbin, and a second gap is formed between an inner wall of the supporting member and an outer wall of the actuating rod, the air flowed through the opening of the casing being flowed into the valve chamber through the first and second gaps.

20. The washing machine as claimed in claim 14, wherein the second duct of the first housing is connected to a draining pipe, and a second solenoid valve assembly, which opens and closes the draining pipe according to an electric signal from the microcomputer, is provided at a predetermined position in the draining pipe.

21. The washing machine as claimed in claim 1, wherein the third means includes a centrifugal pump.

22. A washing machine comprising:

a cabinet;

an outer tub for receiving a washing liquid, the outer tub being disposed in the cabinet;

a spin tub having a plurality of discharging pores at a side wall, the spin tub being accommodated in the outer tub;

a pulsator for generating a swirl-shaped liquid flow in the spin tub, the pulsator being mounted on a bottom wall of the spin tub;

a motor for generating a rotational force;

a spin tub driving section including a rotating plate secured to a bottom surface of the spin tub and a spin tub driving shaft connected to the motor so as to receive the rotational force from the motor, the spin tub driving shaft being securely inserted into a center portion of the rotating plate;

a pulsator driving shaft connected to the motor so as to receive the rotational force from the motor, the pulsator driving shaft being rotatably accommodated in the spin tub driving shaft, and a lead end of the pulsator driving shaft being fixedly coupled to a center of a bottom surface of the pulsator; and a centrifugal pump for circulating the washing liquid into a spraying nozzle mounted on an upper portion of the outer tub and for generating an air bubble in the washing liquid, the third means supplying the washing liquid having the air bubble into the outer tub, wherein the outer tub is formed at a bottom wall thereof with a first fluid port for discharging the washing liquid to the centrifugal pump and a second fluid port for receiving the washing liquid from the centrifugal pump, the pulsator has a plurality of first blades for generating the swirl-shaped liquid flow in the spin tub and has a center hole formed at a center thereof, each first blade has at least one aperture in the vicinity of the center of the pulsator, the rotating plate includes a receptacle which makes contact with the bottom wall of the outer tub so as to receive the washing liquid flowing from the centrifugal pump through the second fluid port, a guide hole for guiding the washing liquid toward the pulsator, and an annular guide strip for introducing the washing liquid into the center hole of the pulsator and into the aperture of each blade, the centrifugal pump includes a first housing, a second housing fixedly coupled to the first housing, an impeller accommodated in the first housing so as to circulate the washing liquid into the spraying nozzle or into the second fluid port, a stator accommodated in the second housing so as to receive an electric signal from a microcomputer, a rotor surrounded by the stator so as to rotate in forward and reverse directions for a predetermined period when the electric signal is applied to the stator, a driving shaft inserted into a center of the rotor in order to rotate together with the rotor, and a first solenoid valve assembly for supplying the air to the impeller, the first housing includes a fluid inlet connected to the first fluid port of the outer tub by a first fluid pipe so as to receive the washing liquid, a first duct connected to the spraying nozzle through a circulation tube, and a second duct connected to the second fluid port of the outer tub through a second fluid pipe, a two-way valve is disposed between the first and second ducts in order to selectively open and close the first and second ducts, the impeller has a suction opening for sucking the washing liquid that has flowed through the fluid inlet of the first housing, a plurality of second blades for transferring the sucked washing liquid to the first duct or the second duct of the first housing while applying a centrifugal force to the sucked washing liquid, and a hub securely coupled to the driving shaft in order to receive a rotational force from the driving shaft, the hub has a plurality of fluid channels communicated with the suction opening and a space formed therein, the driving shaft has a first and a second end which are opposite to each other, the first end of the driving shaft is fixedly inserted into the hub and the second end of the driving shaft is rotatably inserted into a bearing of a bearing holder which is inserted into a distal end of the second housing, the bearing holder has a screw hole formed at a center thereof, the driving shaft has a fluid passage which longitudinally passes through the driving shaft, the fluid passage has an air inlet at a first end thereof and a recess at a second end thereof which is opposite to the first end of the fluid passage, the recess has a check valve therein, the fluid passage tapers from the second end thereof to the first end thereof, the first solenoid valve assembly includes a casing having an opening for receiving an air, a screw portion having a valve chamber communicated with the fluid passage, a spool valve accommodated in the valve chamber so as to intermittently block the air flowing into the valve chamber, a hollow bobbin installed in the casing, a solenoid wound around a periphery wall of the hollow bobbin, a movable core which reciprocates within the hollow bobbin when an intermittent electric signal is applied to the solenoid, a supporting member for restraining a movement of the movable core, a spring disposed between the movable core and the supporting member in order to elastically support the movable core, and an actuating rod for intermittently pushing the spool valve so as to allow the air to flow into the valve chamber, the screw portion is screw-coupled into the screw hole of the bearing holder, the actuating rod has a first and a second end which are opposite to each other, the first end of the actuating rod is fixedly coupled to the movable core, the second end of the actuating rod is extended up to the valve chamber and is coupled to the spool valve in the valve chamber, a first gap is formed between an outer wall of the movable core and an inner wall of the hollow bobbin, a second gap is formed between an inner wall of the supporting member and an outer wall of the actuating rod, the air flowing through the opening of the casing flows into the valve chamber through the first and second gaps, the second duct of the first housing is connected to a draining pipe, and a second solenoid valve assembly, which opens and closes the draining pipe according to an electric signal from the microcomputer, is provided at a predetermined position in the draining pipe.

* * * * *